US006385883B1

(12) United States Patent
Votolato

(10) Patent No.: US 6,385,883 B1
(45) Date of Patent: May 14, 2002

(54) PORTABLE SIGN

(76) Inventor: Earl J. Votolato, PMB 400, 3419 Via Lido, Newport Beach, CA (US) 92663

( * ) Notice: Subject to any disclaimer, the term of this patent is extended or adjusted under 35 U.S.C. 154(b) by 0 days.

(21) Appl. No.: 09/587,963

(22) Filed: Jun. 6, 2000

(51) Int. Cl.[7] ..... G09F 7/12; G09F 3/10; B42D 15/10

(52) U.S. Cl. ..... 40/594; 40/638; 40/773; 40/630; 283/81

(58) Field of Search ..... 40/594, 638, 773, 40/630; 283/81

(56) References Cited

U.S. PATENT DOCUMENTS

| | | | | | |
|---|---|---|---|---|---|
| 2,307,406 | A | * | 1/1943 | Howard | 156/199 |
| 2,586,039 | A | * | 2/1952 | Heggedal | 40/594 |
| 3,221,427 | A | * | 12/1965 | Kaplan | 40/2 |
| 3,967,022 | A | * | 6/1976 | Hasei | 40/2 R |
| 4,479,838 | A | * | 10/1984 | Dunsirn et al. | 283/81 |
| 4,637,149 | A | * | 1/1987 | Rivkin | 40/2 R |
| 4,671,003 | A | * | 6/1987 | Vitol | 40/2 R |
| 4,741,119 | A | * | 5/1988 | Baryla | 40/594 |
| 4,749,222 | A | | 6/1988 | Idland | |
| 5,207,011 | A | * | 5/1993 | Coulthard | 40/594 |
| 5,334,431 | A | * | 8/1994 | Longtin | 283/81 |
| 5,829,507 | A | * | 11/1998 | Pawlowski | 296/97.7 |
| D412,184 | S | * | 7/1999 | Garrett | D20/11 |
| 6,030,002 | A | * | 2/2000 | Charley et al. | 283/81 |
| 6,098,323 | A | * | 8/2000 | McGuiness | 40/594 |
| 6,113,271 | A | * | 8/2000 | Scott et al. | 40/630 |

FOREIGN PATENT DOCUMENTS

| | | | | |
|---|---|---|---|---|
| DE | 2160293 | * | 6/1973 | 40/594 |
| FR | 1183280 | * | 7/1959 | 40/594 |
| FR | 1558538 | * | 2/1969 | 40/594 |
| FR | 2533054 | * | 3/1984 | 40/638 |
| GB | 475555 | * | 11/1937 | 40/594 |
| GB | 698584 | * | 10/1953 | 40/594 |
| GB | 2231551 | * | 11/1990 | 40/594 |

* cited by examiner

*Primary Examiner*—Stephen T. Gordon
*Assistant Examiner*—Hillary Gutman
(74) *Attorney, Agent, or Firm*—Stetina Brunda Garred & Brucker

(57) ABSTRACT

A portable sign for attachment to a generally vertical surface such as a glass pane. The sign includes a sheet of electrostatically engaging material having printed thereon sign indicia and having a plurality of edges. A non-electrostatically engaging material or coating is disposed along substantially at least one of an entire front and back opposing length adjacent the at least one edge for easy finger grasp thereof and resulting sign removal from the vertical surface when signage is no longer desired.

3 Claims, 1 Drawing Sheet

PORTABLE SIGN

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

This invention relates in general to signs, and in particular to a portable sign especially exemplified by a safety sign electrostatically attachable to a vertical surface such as a glass pane for temporary or permanent retention, and having along an adjacent length of at least one edge thereof a non-electrostatically engaging material or coating for convenient finger grasping to thereby effectuate easy removal of the sign from the vertical surface.

Specialty in-door signs such as those used for safety messages that relate to temporary hazards in public places are well known. Examples of such warning signs include those advising of wet-floor slippery conditions, workers performing repairs, temporarily restricted spaces, and the like. Typically, these prior-art signs either are self-supporting for floor placement and include a support post or an A-frame design, or are attached to or free-hanging on a wall near the subject hazard. Unfortunately, such floor-placed signs can, themselves, be a hazard if a person accidently trips over such a sign placed in a walkway. Additionally, for both the floor-placed and wall-attached prior-art signs, convenient portability and/or storage is not realized. Additionally, because of their size or placement requirements, these prior-art signs many times cannot be situated most opportunely to advise the public and employees of the particular hazard at the earliest time and well before the danger is encountered.

In view of these disadvantages and shortcomings of such prior-art signage, it is apparent that a need is present for a portable sign whose placement can be accomplished advantageously and whose physical characteristics permit selective sign display at one site along with convenient portability for repositioning at a different site. Accordingly, a primary object of the present invention is to provide a portable sign for easy attachment to and removal from a generally vertical surface such as a glass pane.

Another object of the present invention is to provide a portable sign wherein attachment to a vertical surface is accomplished electrostatically.

Yet another object of the present invention is to provide a portable sign wherein the sign is provided along the length of one edge thereof a non-electrostatically engaging material or coating for convenient finger grasping and therefore easy sign removal from the vertical surface.

These and other objects of the present invention will become apparent throughout the description thereof which now follows.

BRIEF SUMMARY OF THE INVENTION

The present invention is a portable sign for attachment to a generally vertical surface such as a glass pane. The sign comprises a sheet of electrostatically engaging material having printed thereon sign indicia and having a plurality of edges. A non-electrostatically engaging material or coating is disposed along substantially at least one of an entire front and back opposing length adjacent the at least one edge for easy finger grasp thereof and resulting sign removal from the vertical surface when signage is no longer desired. When both opposing lengths have such material or coating, either side of the sign can be engaged with the vertical surface and provide finger grasp removal.

In a preferred embodiment the electrostatically engaging material is a polymer material which can be non-limitedly exemplified as vinyl, while the sign indicia relates to safety messages, and can include word(s) and/or pictorial or graphic image(s) to convey the information. Preferably, the non-electrostatically engaging material or coating is non-opaque and extends inwardly from the edge a distance from about 0.25 to about one inch. Because of this attachment and removal versatility, the sign can be located, for example, on doorway glass to thereby advise entrants of a hazard inside a structure before entry occurs as opposed to hazard-site sign placement only. When the hazard no longer exists, the non-electrostatically engaging material or coating, which does not attach to the vertical surface, is easily finger-graspable for easy disengagement of the electrostatically engaging material and ultimate removal of the sign for storage, disposal, or re-attachment to another site.

BRIEF DESCRIPTION OF THE SEVERAL VIEWS OF THE DRAWING

An illustrative and presently preferred embodiment of the invention is shown in the accompanying drawings in which.

DETAILED DESCRIPTION OF THE INVENTION

Figure 1:
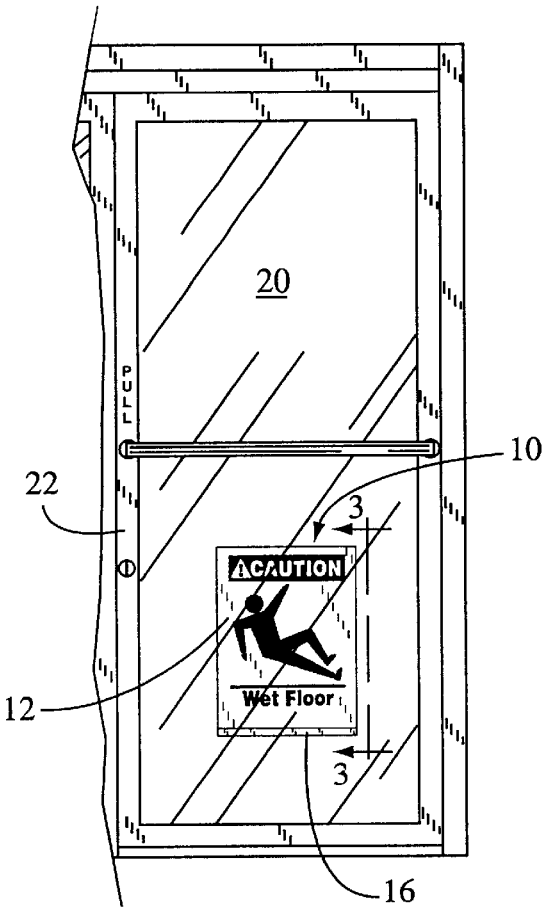
FIG. 1 is a front elevation view of a portable sign attached to a glass pane of a door.
Figure 2:
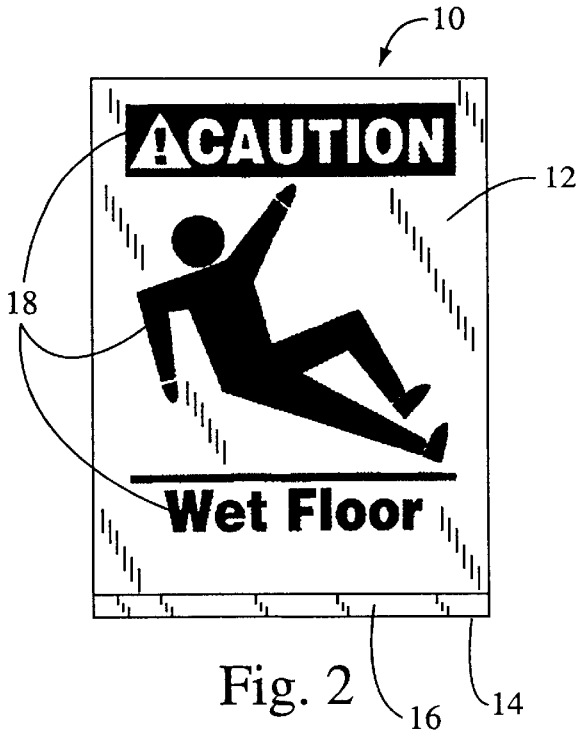
FIG. 2 is a front elevation view solely of the portable sign of FIG. 1.
Figure 3:
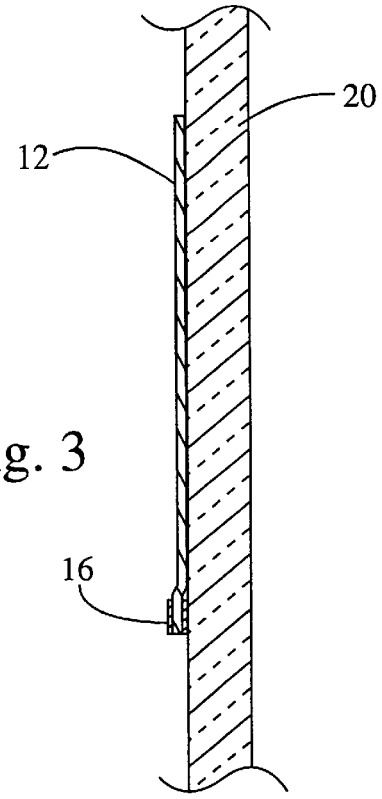
FIG. 3 is a side elevation view in section along line 3—3 of FIG. 1.

Referring to FIGS. 1–3, a portable sign 10 comprising a four-edged flexible rectangular sheet 12 fabricated of electrostatically engaging vinyl plastic. Along substantially the entire length of one edge 14 thereof is a non-electrostatically engaging material or coating here non-limitedly exemplified as an adhesive polymer tape 16 shown especially in FIG. 3 as extending inwardly on both sides from and adjacent the edge 14 a distance from about 0.25 to about one inch. Of course, the tape 16 can be included only on one side of the sheet 12 so long as that side is the only side to be in contact with a vertical surface to which the sign 10 is to be attached. The tape 16 is preferably non-opaque, and is most preferably clear when in place on the sheet 12. Printed on the sheet 12 are sign indicia 18 which can include one or more words and/or images as exemplified in FIGS. 1 and 2.

In use, and as particularly illustrated in FIGS. 1 and 3, the sheet 12 of the sign 10 is electrostatically affixed to a vertical surface such as a glass pane 20 of an entry door 22 to thereby present a message such as a cautionary warning as shown to pedestrians entering through the door 22. Along the one edge 14 where the tape 16 is provided is, of course, the non-electrostatically engaging portion of the sign 10 which does not adhere to the glass pane 20 and thus is easily finger-graspable to permit pealing of the remainder of the sheet 12 from the pane 20 when the sign 10 is no longer needed at its site. In this manner, a highly practical sign is provided for effective placement and message delivery while simultaneously providing highly convenient ease of removal when signage is no longer needed.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A portable sign for attachment to a generally vertical surface, the sign comprising:

a) a sheet of electrostatically engaging material having printed thereon sign indicia and having a plurality of edges; and b) a non-opaque and non-electrically engaging material disposed along substantially at least one of an entire front and back opposing length of the sheet adjacent at least one said edge.

2. A portable sign for attachment to a generally vertical surface, the sign comprising:

a) a sheet of electrostatically engaging material having printed thereon sign indicia and having a plurality of edges; and b) a non-electrically engaging material disposed along substantially at least one of an entire front and back opposing length of the sheet adjacent at least one said edge wherein the non-electrostatically engaging material extends inwardly from said at least one edge on said at least one adjacent front and back opposing length a distance from about 0.25 to about one inch.

3. A portable sign for attachment to a generally vertical surface, the sign comprising:

a) a sheet of electrostatically engaging material having printed thereon sign indicia and having a plurality of edges; and b) a non-electrically engaging material disposed along substantially at least one of an entire front and back opposing length of the sheet adjacent at least one said edge wherein the non-electrostatically engaging material extends inwardly from said at least one edge on both said adjacent front and back opposing lengths a distance from about 0.25 to about one inch.

* * * * *